United States Patent [19]

Talonen et al.

[11] 4,388,111

[45] Jun. 14, 1983

[54] PROCESS FOR THE RECOVERY OF LEAD FROM A LEAD-BEARING SULFIDE CONCENTRATE

[75] Inventors: Timo T. Talonen, Nakkila; Tuula S. M. Mäkinen, Vanha-Ulvila, both of Finland

[73] Assignee: Outokumpu Oy, Helsinki, Finland

[21] Appl. No.: 254,413

[22] Filed: Apr. 15, 1981

[30] Foreign Application Priority Data

Apr. 16, 1980 [FI] Finland ..... 801213

[51] Int. Cl.[3] ..... C22B 13/00

[52] U.S. Cl. ..... 75/26; 75/77; 75/92

[58] Field of Search ..... 75/77, 26, 92

[56] References Cited

U.S. PATENT DOCUMENTS

| | | | |
|---|---|---|---|
| 3,891,430 | 6/1975 | Cole, Jr. et al. | 75/77 |
| 4,080,197 | 3/1978 | Meissner et al. | 75/77 |
| 4,102,676 | 7/1978 | Jaquay | 75/77 |
| 4,326,884 | 4/1982 | Soriano et al. | 75/77 |

*Primary Examiner*—M. J. Andrews

*Attorney, Agent, or Firm*—Brooks, Haidt, Haffner & Delahunty

[57] ABSTRACT

Lead is recovered from a lead-bearing sulfidic concentrate by heating the concentrate in such a manner that lead and its compounds pass into the gas phase. The oxygen pressure in the gas phase is adjusted by oxidation or reduction in order to cause the compounds of lead to react with each other to form lead, and the gas phase is cooled in order to condense the metallic lead out from the gas.

2 Claims, 3 Drawing Figures

Pb, PbO, PbS, CO, H2O, H2 mol-%
SO2, N2 mol-%
15
60
10
40
5
20
Total amounts of materials
ΣPb = 2,365 kmol
ΣS = 4,517 kmol
ΣO2 = 6,0503 kmol
ΣN2 = 1,554 kmol
ΣC = 0,9445 kmol
ΣH2 = 1,1806 kmol
Pb
H2O
SO2
CO2
PbO
N2
PbS
H2
CO
900 1173
1000 1273
1100 1373
1200 1473
1300 1573
1400 1673
[°C]
[K]
Temperature lg ( PCO2 / PCO )
1073 800
1173 900
1273 1000
1373 1100
1473 1200
1573 [ K ] 1300 [ °C ]
4,5
4,0
3,5
3,0
2,5
2,0
1,5
1,0
0,5
0
PbSO4
PbO · PbSO4
2PbO·PbSO4
Y
PbO, PbSO4 liquid solutions aPbO=1
Pb
PPbS = 0,05atm
PbS crystallized
PSO2 = 1atm
PbS in liquid
PbS m. pt.
PPbS = 0,25atm
0,1 p-%S
0,2 p-%S
0,5 p-%S
1,0 p-%S
2,0 p-%S
10 p-%S
12 p-%S
10,0
9,5
9,0
8,5
8,0
7,5
7,0
6,5
6,0
10⁴/T

PROCESS FOR THE RECOVERY OF LEAD FROM A LEAD-BEARING SULFIDE CONCENTRATE

BACKGROUND OF THE INVENTION

The present invention relates to a method for the recovery of lead from a lead-bearing sulfide concentrate by heating the concentrate so that the compounds of lead pass into the gas phase.

Most of the world's lead is produced from lead-bearing sulfide concentrates by a sintering-shaft-furnace process. In the sintering machine the concentrate is oxidized in order to remove the sulfur and it is brought into a particle form suitable for shaft-furnace reduction.

The greatest disadvantage of the process is its large quantities of waste gas, which are produced during both the sintering and the shaft-furnace process. It has been estimated that process and ventilation gases which contain sulfur dioxide and dusts are produced at a rate of about 670 kmol (15 000 $Nm^3$) per one tonne of concentrate. The purification of the waste gases to correspond to the current requirements of environmental protection causes a considerable increase in the costs of lead production.

The aim of recent research has been to create a process in which the sulfur dioxide is obtained in a concentrated form and the quantity of dust-bearing waste gases is minimal. In principle, a single-stage process is possible for pure concentrates which contain only very little quarz. Sulfidic lead concentrate is oxidized directly to metal in one process stage. As a sub-reaction, lead sulfide sulfidizes first to oxide according to the reaction below $$PbS+\tfrac{1}{2}O_2=PbO+SO_2$$

Thereafter, the excess lead sulfide reduces the oxide to metal according to the following reaction $$2PbO+PbS=3Pb+SO_2$$

At a low operating temperature of the process, lead sulfate and oxysulfates are obtained instead of oxide. Metallic lead is produced when these compounds react with lead sulfide.

The single-stage lead production process is best applicable to pure concentrates. Owing to the great mutual affinity of lead oxide and silica, the concentration of lead in the slag increases and the yield of metallic lead decreases as the concentration of quartz in the concentrate increases. Releasing lead from the silicate requires so low an oxygen pressure that, in the presence of sulfur dioxide, lead sulfide is obtained instead of metallic lead.

At those temperatures and oxygen pressures which are used in direct production of lead, the zinc present in the concentrate oxidizes and passes into the slag. In order to maintain the melting point of the slag sufficiently low, the slag has to be fluxed, which for its part increases the losses of lead into the slag.

Processes of several stages have been applied to the treatment of impure concentrates. It has been possible to eliminate the disadvantages of the sintering process, i.e. dilute sulfur dioxide gas and passing of lead oxide dust into the environment, the formation of sulfates and difficulties in temperature control, by shifting to closed reactors, the product of which is a melt containing the lead oxide. Such is, for example, the Kivcet process (FI Lay-Open Print 56028).

The vapor pressure of lead sulfide especially, but also of lead oxide, is high at the operating temperatures of the lead production process. This is the reason for the large quantities of fly dusts, which are typical of the process and highly detrimental. Both in a multi-stage and in a single-stage process there occurs volatilization of both lead sulfide and oxide. The boiling point of lead sulfide is about 1610 K. and that of lead oxide about 1810 K., and so at the processing temperatures the gas may contain large quantities of the said compounds. Volatilized lead compounds leave the processing apparatus along with the sulfur-dioxide bearing gas.

Depending on the sulfur dioxide pressure, only lead sulfide, sulfate and various oxysulfates are stable below 1050–1150 K. For this reason, the dust separated from cooled gas, the dust possibly representing a very high proportion of the lead amount fed into the process, mainly consists of these compounds. The amount of lead oxide is less.

Feeding the fly dust to the oxide reduction stage is not possible because of its sulfur content. During the reduction stage the sulfur would be reduced and would leave along with the gas in the form of lead sulfide. Likewise, the concentration of sulfur in the lead produced would be high. The most common method of treating the dust is to feed it back to the oxidation stage together with fresh concentrate. However, there is the disadvantage in the amount of energy required by the endothermal decomposition reactions of the sulfates and the increase in the gas quantity in the process owing to the high rate of recycling of dust.

One of the main objectives in the development of lead processes has been to reduce the amounts of dust. One method to achieve this has been to cool the gas in the outlet section of the oxidation reactor so that the lead compounds condense and fall back into the hot melt. This procedure is used in the Kivcet process. However, the return of cooled dust, which possibly contains sulfates, results in excessive consumption of heat.

Furthermore, U.S. Pat. No. 4,169,725 discloses a process for the suspension smelting of sulfidic complex or mixed ores or concentrates in order to separate the impurities present in them, a process in which the non-volatile impurities are subjected to a reducing or sulfidizing treatment in the lower section of the reaction zone in order to return them to the gas phase before the solid is separated and impinges against the melt. By this procedure it is ensured that the impurities will not substantially pass into the melt but remain in the gas phase. In this patent it is noted that a considerable amount of lead oxide can be made to remain in the gas phase in spite of the reduction and that the lead sulfides can be evaporated to low concentrations in the gas phase without the oxidation of the sulfide. It is also noted that the reduction and sulfidization of lead from molten silicates is difficult.

Another method, applied in several processes, for decreasing the amount of dust is to inject the sulfide concentrate either to the melt surface or below the surface of the melt in the furnace. Thus a rapid dissolving of the sulfide in the molten lead or a reaction with the lead oxide present in the slag is effected, and thereby the activity of the lead sulfide decreases and its volatilization decreases.

None of the methods described above entirely eliminates the dust problem involved in lead production processes. A large proportion of the lead content of the concentrate continues to be removed along with the gas and is sulfated or sulfidized during the cooling of the gas.

The object of the present invention is thus to eliminate the entire dust problem involved in prior known lead production processes and to provide a process for the recovery of lead from a lead-bearing sulfide concentrate by heating the concentrate in such a manner that the compounds of lead pass into the gas phase.

SUMMARY OF THE INVENTION

The present invention is based on the observation that it is possible to exploit the dependence of the concentration of lead in a gas which contains lead, sulfur and oxygen on both the oxygen pressure and the temperature of the gas in such a manner that substantially all the compounds of lead can be caused to remain in the gas phase and react in it to form metallic lead, which is thereafter separable from the gas phase.

At a low oxygen pressure, the lead present in a gas is mainly in the form of lead sulfide, the vapor pressure of which is higher than that of lead oxide and metallic lead. At a high oxygen pressure, the lead is mainly present in the form of oxide, the temperature of which at the smelting temperatures is also higher than that of metallic lead. Within the range between the extreme oxygen pressures mentioned above, there appears in the gas, in addition to the two compounds mentioned above, metallic lead in a thermodynamic equilibrium corresponding to the oxygen pressure in the gas and to the temperature of the gas.

The process according to the invention can be carried out advantageously by first heating the sulfide concentrate either at a low oxygen pressure or at a high oxygen pressure, so that a maximal quantity of the lead compounds passes into the gas phase, whereafter the gas phase is oxidized or respectively reduced in order to control its oxygen pressure. The sulfide concentrate is heated preferably to so high a temperature that it melts, for example to a temperature which is 1373 K. at minimum and preferably 1773 K. at maximum, and the oxygen pressure is adjusted respectively to approximately $2\cdot10^{-7}$ atm at maximum and respectively preferably to approximately $2\cdot10^{-4}$ atm at maximum. If the sulfide concentrate is first heated at a high oxygen pressure, the heating is carried out to 1373 K. at minimum and preferably to 1873 K. at maximum and the oxygen pressure is adjusted respectively to $5\cdot10^{-10}$ atm at minimum and to $6\cdot10^{-6}$ atm at maximum.

When the metallic lead has been formed in the gas phase, the gas phase is cooled to a temperature which is 1073 K. at minimum and at which the oxygen pressure is $(0.1\text{–}1)\cdot10^{-10}$ atm at minimum, and most of the lead is condensed at a temperature which is 1272 K. at minimum and at which the oxygen pressure is $10^{-10}$—$10^{-7}$ atm, the remainder being condensed at a temperature lower than the above.

The gas phase can be cooled by feeding into the gas phase a cooling agent such as water, cold gas or advantageously lead, in which case the control of the oxygen pressure and the cooling are advantageously carried out in the same stage by feeding to this stage a cold oxidizing agent or reducing agent while cooling.

DESCRIPTION OF THE PREFERRED EMBODIMENTS

If the oxygen pressure is low and the operation is carried out at a temperature at which the slag composed of the secondary constituents of the concentrate is molten, the gas can usually contain all the lead of the concentrate without being saturated with lead sulfide. At a high oxygen pressure, the same applies regarding lead oxide. If, on the other hand, the operation is carried out at a suitable oxygen pressure between the extreme oxygen pressures described above, the low vapor pressure of metallic lead, compared with the vapor pressures of sulfide and oxide, limits the amount of lead present in the gas.

Figure 1:
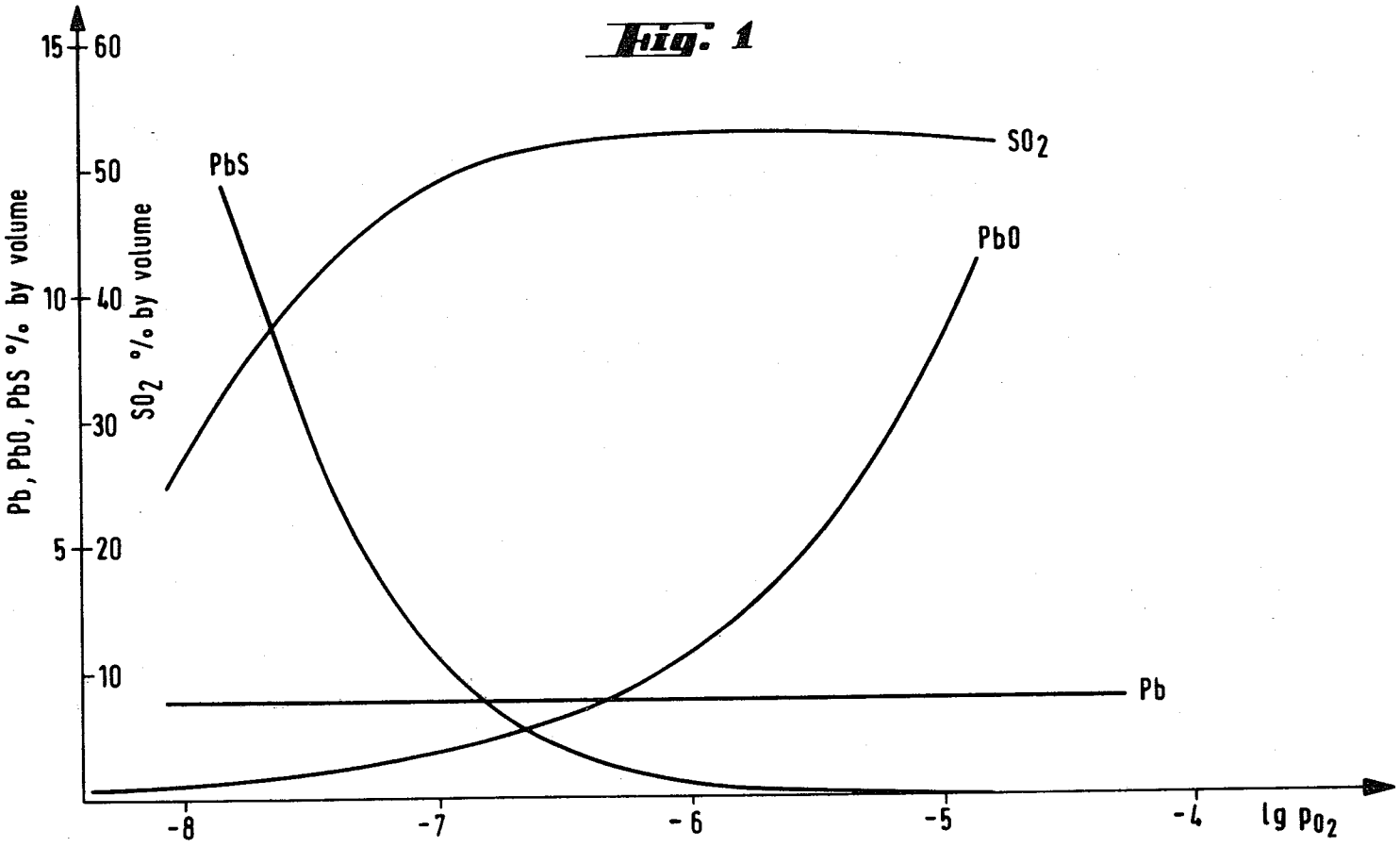
FIG. 1 depicts the concentrations of lead, lead oxide and lead sulfide, as well as sulfur dioxide, in percent by volume at 1373 K. in a gas which contains sulfur, oxygen, nitrogen and lead, as a function of the oxygen pressure in equilibrium with metallic lead.

As an illustration, FIG. 1 shows the composition of a gas which contains sulfur, oxygen, nitrogen and lead, at a constant temperature, 1373 K., as a function of the oxygen pressure in equilibrium with metallic lead.

When the oxygen pressure in the gas at 1373 K. is adjusted towards the optimum, about $6\cdot10^{-7}$, the concentration of either PbS or PbO, depending on the direction from which the optimum is approached, begins to decrease. When the oxygen pressure is adjusted further towards the optimum after the point of saturation of metallic lead has been reached, the metallic lead begins to condense as a liquid. The condensation of metallic lead causes a total reaction of sulfide and oxide:

$$PbS(g)+2PbO(g)\rightarrow 3Pb(l)+SO_2(g) \quad (1)$$

At the optimum oxygen pressure, the sum of the gaseous substances PbS(g), PbO(g) and Pb(g) is at its minimum.

Figure 2:
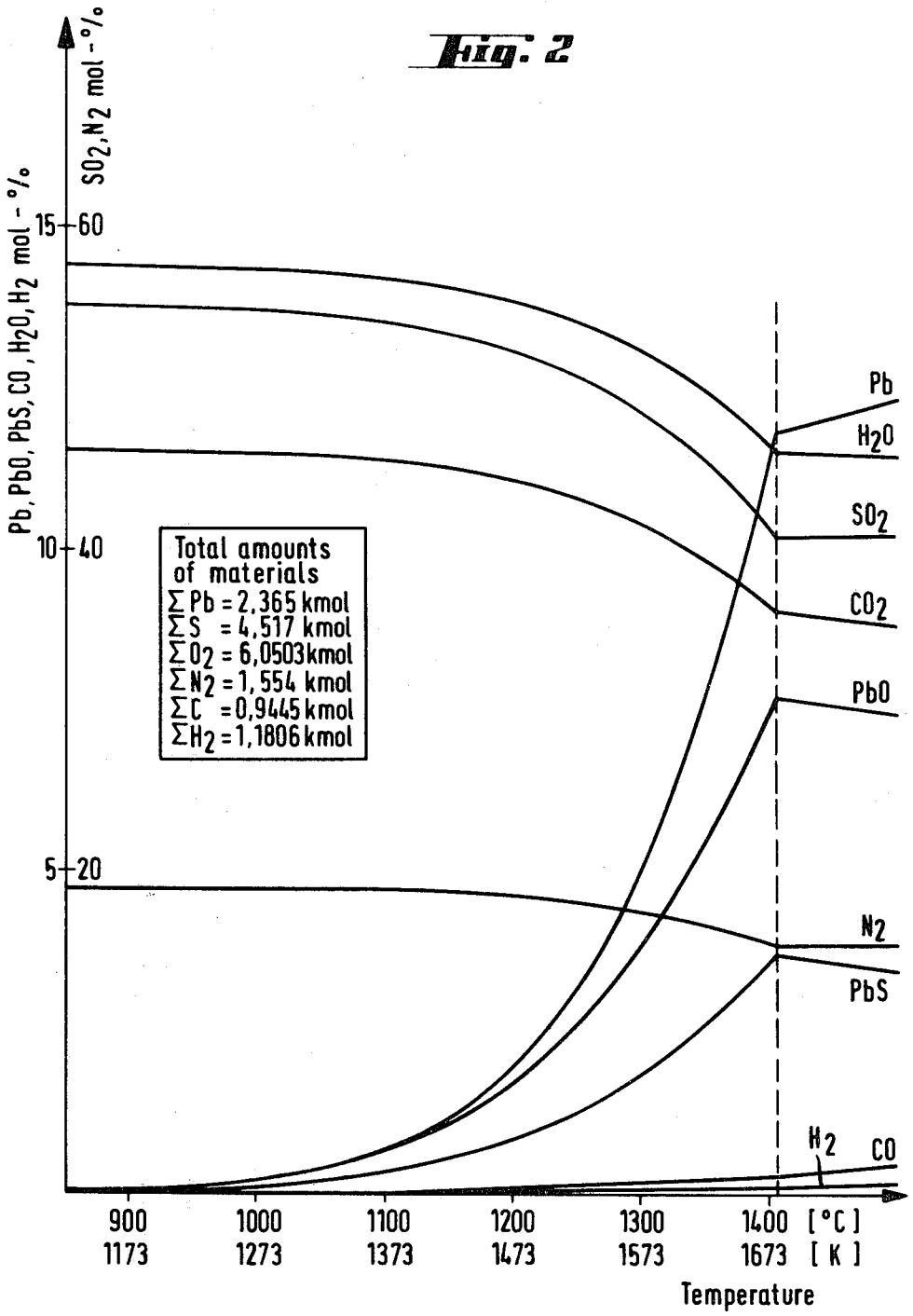
FIG. 2 is a diagram of the composition, as a function of the temperature, of a gas the oxygen pressure of which has been adjusted to the optimal.

At a sufficiently high temperature, the vapor pressure of metallic lead is also so high that, regardless of the oxygen pressure, in an extreme case all of the lead treated in the process can be taken up by the gas phase and the gas is still undersaturated with lead. FIG. 2 shows the composition of a gas the oxygen pressure of which has been controlled optimally, i.e. as a function of the temperature. The gas has been obtained from the smelting of lead concentrate by means of almost only oxygen.

The dew point of the gas with regard to metallic lead is about 1680 K. When the gas is cooled to below its dew point, metallic lead condenses and the PbS and PbO of the gas react with each other, the final product being liquid lead. In certain process conditions, 97% of the lead content of the gas is condensed to metallic lead already at 1373 K. At 1173 K. the gas is practically free of lead.

Figure 3:
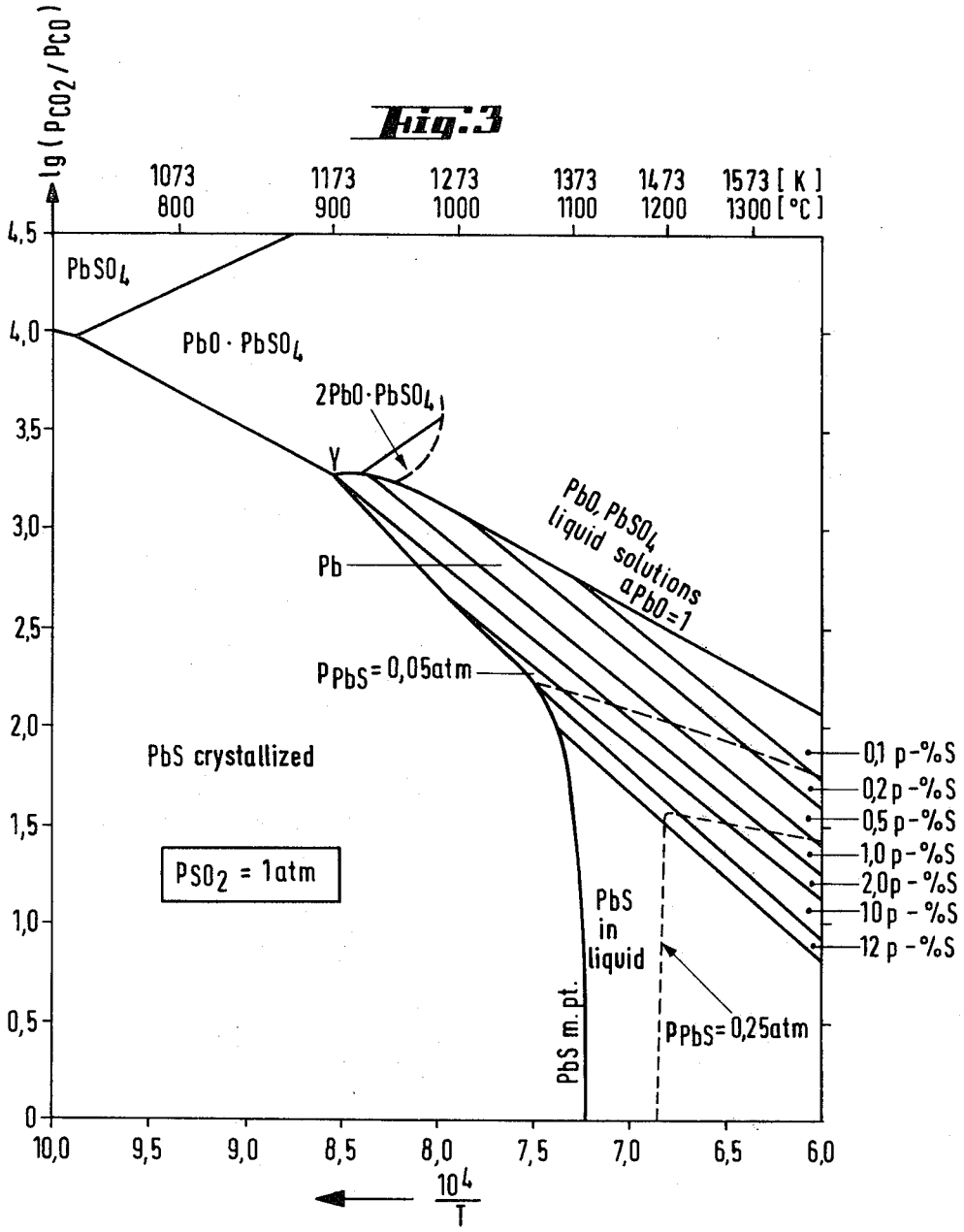
FIG. 3 is an equilibrium diagram of the system Pb-S-O at a sulfur dioxide pressure of 1 atmosphere.

It is seen from FIG. 3 that at a sulfur dioxide pressure of 1 atm metallic lead is stable only above approximately 1173 K. At this temperature, however, the sulfur content of the lead is high. When the oxygen pressure of the gas at 1373 K. is adjusted to its correct value, 97% of the lead content of the gas described above can be condensed in such a manner that the sulfur content of the lead is only about 0.1%. Sulfur contents even lower than this have been achieved in laboratory experiments.

In the process according to U.S. Pat. No. 4,169,725 no attempt is made to adjust the oxygen pressure to the stability range of metallic lead and, furthermore, the aim is to retain an operating temperature at which the vapor pressure of metallic lead is also high, and lead and its compounds remain in the gas phase when the solid in suspension is being separated.

Essential parts of the process can be improved by applying to lead production processes the thermodynamic behavior of the gas described above, which contains among other things sulfur, oxygen and lead. The oxygen pressure of the gases coming from the oxidation stages of the process is usually so high that the lead present in them is in oxidic form. Such a gas is directed at a high temperature to a reduction zone, to which some reductant such as carbon or a hydrocarbon is fed in addition to the gas at such a rate that the oxygen pressure of the gas reaches its optimum value, taking the temperature into account.

By thereafter cooling the gas to a temperature of 1000–1500 K., depending on the sulfur dioxide pressure in the gas, the lead content of the gas is caused to condense to metal. The metal mist can be removed from the gas by known methods. The small amount of lead and compounds of lead remaining in the gas condenses during a subsequent cooling of the gas and can be recovered in the form of lead sulfide and sulfates. This dust can be returned to the smelting process.

The gas leaving the reduction zone of a two-stage lead process may contain lead not only in the form of metallic vapor but also in the form of a sulfide, owing to the incomplete oxidation during the oxidation stage. It is advisable to direct such a gas not to the reduction zone but instead to the oxidation zone, in which the oxygen pressure of the gas is adjusted by means of technical oxygen, air, a mixture of these, or some other oxidant, to the same value as it was adjusted in the reduction zone in the case of an oxygen-rich gas. In order to condense the lead, the gas is treated in the same manner.

In order to obtain optimal results, not only the pressure of oxygen but also its temperature in the condensation zone must be controlled with precision. If the condensation is carried out at too high a temperature, the quantity of lead and compounds of lead remaining in the gas phase is high. If, on the other hand, the temperature during condensation is too low, the sulfur content of the condensing lead is high or the product may comprise, instead of metallic lead, varying amounts of lead sulfide, lead sulfate or lead oxysulfates, depending on the pressures of sulfur dioxide and oxygen.

The gas can be cooled to the condensation temperature by known methods, for example most advantageously by so-called direct cooling, in which a suitable amount of water, liquid lead or a cold gas which does not cause harmful reactions in the process gas is injected into the gas. In indirect cooling, in order to produce an adequate cooling bath, the heat transfer surfaces must be at a temperature lower than that to which the process gas must be cooled, possibly even below the stability range of lead. In this case, the sulfur content of the lead accumulating on the heat transfer surfaces is high or lead sulfates and sulfide are formed on them.

After the adjustment of the oxygen pressure, before the cooling of the gas, a large proportion of its lead content is in the form of sulfide and oxide. During the cooling and thereafter, these react with each other, forming metallic lead, which condenses. In order to produce as complete a reaction as possible, it may be necessary to arrange retention time for the gas before the separation of liquid lead. It might also be necessary to carry out the cooling in several stages and to allow the gas to react in between or to carry out the cooling in accordance with a certain time-dependent function.

In order to control the sulfur content in the lead and the distribution of impurities, it may be necessary to carry out a condensation of most of the lead at a higher temperature, for example 1473 K., and a second condensation at a lower temperature, for example 1173 K., in which case the sulfur content of the lead condensed during the latter stage is higher. At a lower temperature the vapor pressure of lead is very low, only about 0.004 bar, so that the rate of recovery of lead is very high. In this case, dusts which would have to be returned to the previous stage of the process are not produced.

In pilot-scale experiments, the oxidation of lead concentrate was carried out in the reaction shaft of a flash smelting furnace in a suspension of gas and solid. Thereby it was observed that the volatilizations of lead and compounds of lead are greatly dependent not only on the temperature of the suspension but also on the degree of oxidation of the concentrate i.e. the oxygen pressure of the gas. At a high temperature (1700–1750 K.) and using a slight oxidation of the concentrate, the volatilization of the lead was at its best over 97%. At the same time about 97% of the silver fed into the reactor also volatilized. The reaction shaft of a flash smelting furnace is very advantageous for volatilization. Owing to rapid heating, the sulfides evaporate out of the concentrate, in which their activity is high, before the metals have time to combine with slag-forming compounds. By further decreasing the degree of oxidation, the corresponding volatilizations may be achieved at a lower temperature.

By applying the control of the gas phase oxygen pressure and temperature in a lead process described above to a flash smelting process or to some corresponding oxidation process, a process is obtained in which the lead content of the lead concentrate can be separated directly in the form of metallic lead in one furnace and lead recovery apparatus.

Oxygen, air or a mixture of these two is fed, either cold or pre-heated, to the volatilization stage of the process, for example into the reaction shaft of a flash smelting furnace, and possibly fuel is also fed in order to increase the temperature. In addition to the oxidation of the fuel, the oxygen to be used for burning the concentrate is controlled optimally in such a manner that the volatilization of the volatile valuable elements present in the concentrate, such as lead and copper, is maximal but that at the same time fuel is used at a rate suitable in terms of the economical result of the process and its thermal balance.

During the next stage of the process, the solid fed into the gas separates from the gas flow and passes onto the floor of the furnace. The compounds of the non-volatile metals, for example copper and iron sulfides, form a matte on the floor of the furnace. A slag is formed on top of the matte by the oxides of the same metals and by slagging substances. The matte and the slag are discharged from the furnace and treated further by known methods.

During the separation stage the gas is directed to the oxidation or reduction stage described above and thereafter to the condensation of lead.

The process has great advantages in comparison with prior known processes. If the furnace is constructed so that the finely-divided dust traveling along with the gas during the oxidation stage is removed effectively from the gas phase during the oxidation stage, an effective separation is achieved between the non-volatile substances, such as copper, iron and slagging components, and on the other hand volatile substances, such as lead, silver, zinc, antimony and arsenic. The removal of non-volatile constituents from the gas can be made more effective by directing the gas to the process stage described above, in which the oxygen pressure is adjusted either by oxidation or by reduction.

Another effective place for separating the secondary constituents of the concentrate in the process is the lead condensation stage. Arsenic, bismuth and other compounds having a high vapor pressure dissolve in the lead only to a slight degree during the condensation stage. When the gas is cooled to the lead condensation temperature, only part of the zinc remains in metallic form in the gas phase, part is dissolved in the produced lead or in the lead used for cooling. If the concentrate has a high zinc content, most of the zinc is oxidized during the condensation and is obtained as a dross from top of the lead.

The invention is described below in greater detail by way of an example.

EXAMPLE 1

The process according to the invention is used for treating a lead concentrate with the following composition:

Pb—72%,
Fe—5%,
S—14%,
$SiO_2$—3%,
CaO—3%,
$Al_2O_3$—3%.

The concentrate is heated to a temperature of 1400 K. by means of flue gases almost devoid of free oxygen, the gases having been obtained by burning a fossil fuel with air, whereby 97% of the lead sulfide content of the concentrate volatilizes. The composition of the gas obtained from the volatilization in our example is as follows:

$CO_2$—9.5%,
Co—1.0%,
$H_2O$—12.5%,
$H_2$—0.6%,
$SO_2$—0.8%,
Na—64.4%,
$H_2S$—0.07%,
$S_2$—0.04%,
PbS—10.1%,
PbO—0.03%,
Pb—0.84%,
$pO_2$—$0.28 \cdot 10^{-11}$ atm.

Next, oxygen is added at a rate of about 0.11 kmol per 1 kmol of gas to the gas obtained from the volatilization stage. Part of the lead sulfide present in the gas oxides to oxide and metal, part remains in sulfidic form.

The composition of the gas after the oxidation stage at 1400 K. is as follows:

$CO_2$—10.4%,
CO—0.05%,
$H_2O$—13.1%,
$H_2$—0.03%,
$SO_2$—10.8%,
$N_2$—64.0%,
Pb—0.84%,
PbS—0.24%,
PbO—0.52%,
$pO_2$—$0.44 \cdot 10^{-7}$ atm.

86% of the lead of the gas coming from volatilization has condensed.

The oxidized gas is cooled to a temperature of 1273 K. Lead vapor continues to condense, and lead sulfide and lead oxide react with each other, forming metal. The composition of the cooled gas is as follows:

$CO_2$—10.6%,
CO—0.01%,
$H_2O$—13.2%,
$H_2$—0.01%,
$SO_2$—11.1%,
$N_2$—64.7%,
Pb—0.18%,
PbS—0.07%,
PbO—0.13%,
$pO_2$—$0.53 \cdot 10^{-9}$ atm.

97% of the lead of the gas has condensed as metal. The remainder condenses in the form of oxide, sulfide, sulfate and oxysulfates of lead during the after-cooling of the gas. This dust is recovered and fed to the volatilization stage or, advantageously, to the oxidation stage of the process.

EXAMPLE 2

At a pilot plant experiment lead concentrate with the following composition was treated by a method according to the invention:

Pb—45.0%,
Fe—6.4%,
Cu—1.8%,
S—14.6%,
$SiO_2$—14.4%,
CaO—2.7%,
MgO—4.6.

In the reaction shaft of the flash smelting furnace concentrate was melted at a rate of about 1000 kg/h at a temperature of 1720 K. For a partial oxidation of the concentrate about 57 kg/h of technical oxygen was fed. For the creation of the necessary additional heat butane was, moreover, burnt in the reaction shaft by using a stoichiometric amount of technical oxygen.

In addition to gas it was received from the reaction shaft as a product slag, matte and metal. The lead content of the slag was about 0.5%. The matte contained lead about 10% and copper about 28% i.e. about 1% and nearly 100% of the lead and copper content of the concentrate, respectively.

Of the lead content of the concentrate about 85% was volatilized into the gas. The composition of the gas after the reaction shaft was the following:

Pb—1.7%,
PbS—12.1%,
PbO—0.1%,
$S_2$—1.5%,
$SO_2$—18.4%,
$CO_2$—24.0%,
CO—7.0%,
$H_2O$—28.0%,
$H_2$—2.4%,
Oxygen pressure—$1.4 \cdot 10^{-7}$.

For oxidation of lead sulfide and other combustible compounds oxygen was fed to the rising shaft of the flash smelting furnace at a rate of about 68 kg/h, whereby the following gas composition was received:

Pb—6.6%,
Pb—1.5%,
PbO—4.3%,
$SO_2$—28.7%,
$CO_2$—26.7%,
CO—1.0%,
Oxygen pressure—$5.8 \cdot 10^{-6}$.

The oxidized gas was conducted to the first cooling stage, where the temperature was lowered to about 1000 K. The temperature was chosen so as not to pass below the dew point of PbO. During the cooling the dew point of the metallic lead is gone below and a part of the lead is condensed.

In the next stage reaction time was given to the gas, whereby PbO and PbS were reacted with each other to metallic lead, and the next cooling was carried out on the same grounds as the previous to a temperature of 1440 K.

Periodic coolings were carried out until the temperature was about 1173 K. Hereby the concentration of the gas was the following:

Pb—0.04%,
PbS—0.02%,
PbO—0.04%,
$SO_2$—33.8%,
$CO_2$—31.0%,
Oxygen pressure—$1.6 \cdot 10^{-9}$.

Of the lead content of the gas about 99% was condensed as metal.

EXAMPLE 3

Lead concentrate with the following concentration is treated by the method according to the invention:

Pb—45.0%,
Fe—7.6%,
S—15.7%,
$SiO_2$—12.1%,
CaO—2.4%,
$Al_2O_3$—1.6%.

The concentrate is fed together with the necessary flux to the reaction shaft of the flash smelting furnace, where it is oxidized by the aid of technical oxygen. As a result a sulfur-free lead oxyde containing slag as well as a gas with the following composition is received.

$O_2$+Ar—3%,
$N_2$—5%,
$SO_2$—77%,
PbO—15%.

The gas received from the melting is conducted to the rising shaft of the flash smelting furnace, where butane gas is mixed with it. After the reduction the composition of the gas is the following:

Pb—6.7%,
PbS—2.4%,
PbO—5.1%,
$S_2$—0.005%,
$SO_2$—70.5%,
$N_2$—4.7%,
$CO_2$—4.5%,
CO—0.2%,
$H_2$—5.8%,
$H_2$—0.06%,
$H_2S$—0.005%,
Oxygen pressure—$1.4 \cdot 10^{-5}$.

The gas leaving the rising shaft is cooled and lead recovery from the gas is carried out. At a temperature of 1273 K. the composition of the gas is the following:

Pb—0.18%,
PbS—0.13%,
PbO—0.25%,
$S_2$—$1.8 \cdot 10^{-5}$,
$SO_2$—82.0%,
$N_2$—5.3%,
$CO_2$—5.3%,
CO—0.003%,
$H_2O$—6.6%,
$H_2$—0.003%,
$H_2S$—$1.4 \cdot 10^{-5}$,
Oxygen pressure—$1.8 \cdot 10^{-8}$.

In our experiment 56% of the lead content of the concentrate has been slagged and can be recovered by the aid of a reduction process. 44% of the lead content of the concentrate has been volatilized into the gas, of which 96.5% has been recovered as metal by the aid of reduction and condensing processes of lead.

What is claimed is:

1. A process for the recovery of lead from a lead-bearing sulfidic concentrate by heating the concentrate in such a manner that lead and lead compounds pass into the gas phase, comprising heating the sulfidic concentrate to a temperature of between 1373° K. and 1773° K. at an oxygen pressure lower than $2 \cdot 10^{-7}$ atm at 1373° K. and lower than $2 \cdot 10^{-4}$ atm at 1773° K., then oxidizing the gas phase and cooling the gas phase to a temperature no lower than 1073° K. at an oxygen pressure no lower than $10^{-12}$ atm to cause lead compounds of the gas phase including sulfides and oxides of lead to react with each other to produce elemental lead, condensing a major portion of the elemental lead produced at a temperature of at least 1272° K. and an oxygen pressure between $10^{-10}$ atm, and condensing the remainder of said elemental lead at a temperature below 1272° K.

2. A process for the recovery of lead from a lead-bearing sulfidic concentrate by heating the concentrate in such a manner that lead and lead compounds pass into the gas phase, comprising heating the sulfidic concentrate to a temperature of at least 1373° K. at an oxygen pressure greater than $5 \cdot 10^{-10}$ atm, and at most 1873° K. at an oxygen pressure which is greater than $6 \cdot 10^{-6}$ atm, then reducing the gas phase and cooling the gas phase to a temperature no lower than 1073° K. at an oxygen pressure between $10^{-12}$ atm and $10^{-11}$ atm to cause lead compounds of the gas phase including sulfides and oxides of lead to react with each other to form elemental lead, and condensing a major part of the elemental lead produced in the gas phase at a temperature no lower than 1272° K. and an oxygen pressure between $10^{-10}$ atm and $10^{-7}$ atm, and condensing the remainder of the elemental lead at a temperature below 1272° K.

* * * * *

UNITED STATES PATENT AND TRADEMARK OFFICE

CERTIFICATE OF CORRECTION

PATENT NO. : 4,388,111

DATED : June 14, 1983

INVENTOR(S) : Timo T. Talonen et al

It is certified that error appears in the above—identified patent and that said Letters Patent is hereby corrected as shown below:

Column 9, line 48:

"oxyde" should be --oxide--.

Signed and Sealed this

*Twenty-fifth* Day of *October 1983*

[SEAL]

*Attest:*

GERALD J. MOSSINGHOFF

*Attesting Officer*

*Commissioner of Patents and Trademarks*